United States Patent [19]

Lapointe et al.

[11] 3,962,799

[45] June 15, 1976

[54] AIR BEARING MOISTURE PROFILER

[75] Inventors: Joseph A. Lapointe, Pointe Claire; Ronald S. Sheel, Kirkland, both of Canada

[73] Assignee: Domtar Limited, Montreal, Canada

[22] Filed: Sept. 24, 1973

[21] Appl. No.: 400,155

[30] Foreign Application Priority Data

Oct. 2, 1972 Canada ..... 153047

[52] U.S. Cl. ..... 34/54; 34/57 R; 34/156; 34/160

[51] Int. Cl.[2] ..... F26B 21/12

[58] Field of Search ..... 34/156, 160, 54, 210, 34/212, 215, 57

[56] References Cited

UNITED STATES PATENTS

| | | | |
|---|---|---|---|
| 3,089,252 | 5/1963 | Daane et al. | 34/160 |
| 3,214,845 | 11/1965 | Huffman | 34/160 |
| 3,771,235 | 11/1973 | Minoda et al. | 34/156 |
| 3,793,741 | 2/1974 | Smith, Jr. | 34/54 |
| 3,837,551 | 9/1974 | Schregenberger | 34/156 |

FOREIGN PATENTS OR APPLICATIONS

| | | |
|---|---|---|
| 886,095 | 11/1971 | Canada |

*Primary Examiner*—Carroll B. Dority, Jr.
*Assistant Examiner*—Larry I. Schwartz
*Attorney, Agent, or Firm*—C. A. Rowley

[57] ABSTRACT

A method and apparatus for drying a sheet while supporting same on an air bearing wherein drying air flows laterally of the bearing in ducts located beneath the drier and is directed to the surface of the drier through intermediate chambers whereby a minimum amount of laterally flowing air contacts with the sheet. Also disclosed is a system of controlling the drying capacity of sections of the drier to permit moisture profile control of the dried sheet.

13 Claims, 7 Drawing Figures

AIR BEARING MOISTURE PROFILER

FIELD OF THE INVENTION

The present invention relates to a dryer, more particularly to an air bearing dryer incorporating means to regulate the drying capacity of the air contacting the web in discrete locations transversely of the web.

DESCRIPTION OF THE PRIOR ART

Air bearings are used to support and in some cases dry webs particularly in the film industry. Similar air bearings to dry relatively wide webs such as those encountered in the paper industry have been proposed but have met only with limited success. It has also been proposed to utilize relatively large diameter bearings and to incorporate both air inlet and exhaust ducting so that the total amount of air contacting the web need not be unduly restricted.

Drying webs on air bearings requires that large volumes of air be injected between the bearing and the web to be dried. These large air volumes require large duct sizes since it is not desirable to use high pressure, high velocity air flows. However, only a certain amount of space is available for the ducting whereby the capacity of the bearings is limited. To overcome the problem, it has been proposed to incorporate a plurality of fans directly within the bearing itself to obtain the recirculation of the drying air.

It has also been proposed to use air bearings divided into discrete sections and to control the drying capacity in each of these sections thereby to obtain a more uniform moisture profile in the dried web. One such device is shown in Canadian Pat. No. 886,095, issued Nov. 16, 1971, to Gunderson. This device contemplates a flat bearing made up of a plurality of discrete sections each of which incorporates a fan with the adjacent sections being interconnected and communicating with a common hot air and exhaust channel. The drying capacity of the air projected against the web in each section is adjusted by regulating the amounts of hot and exhaust air entering the fan.

It is an object of the present invention to provide a dryer structure facilitating the flow and distribution of air across the drier.

It is another object of the present invention to provide a simplified system for controlling the drying capacity of various sections of an air bearing.

It is a further object of the present invention to provide an air bearing profiler wherein close adjustment of the input and exhaust air from each discrete drier section is attainable.

SUMMARY OF THE INVENTION

Broadly, the present invention relates to an air bearing drier having means dividing it into a plurality of side-by-side sections each of which is adapted to dry a portion of a web travelling thereover, a chamber in each said section, duct means extending substantially the full width of said drier beneath said chambers, opening means for directing air from said duct means into each of said chambers and valve means for adjusting the flow from said duct means into each of said chambers thereby to create a positive air pressure in said chamber and orifice means communicating with said chambers for directing air from each of said chambers against the undersurface of the web being dried.

BRIEF DESCRIPTION OF THE DRAWINGS

Further features, objects and advantages will be evident from the following detailed description of the preferred embodiment of the present invention taken in conjunction with the accompanying drawings in which.

DESCRIPTION OF THE PREFERRED EMBODIMENTS

Figure 1:
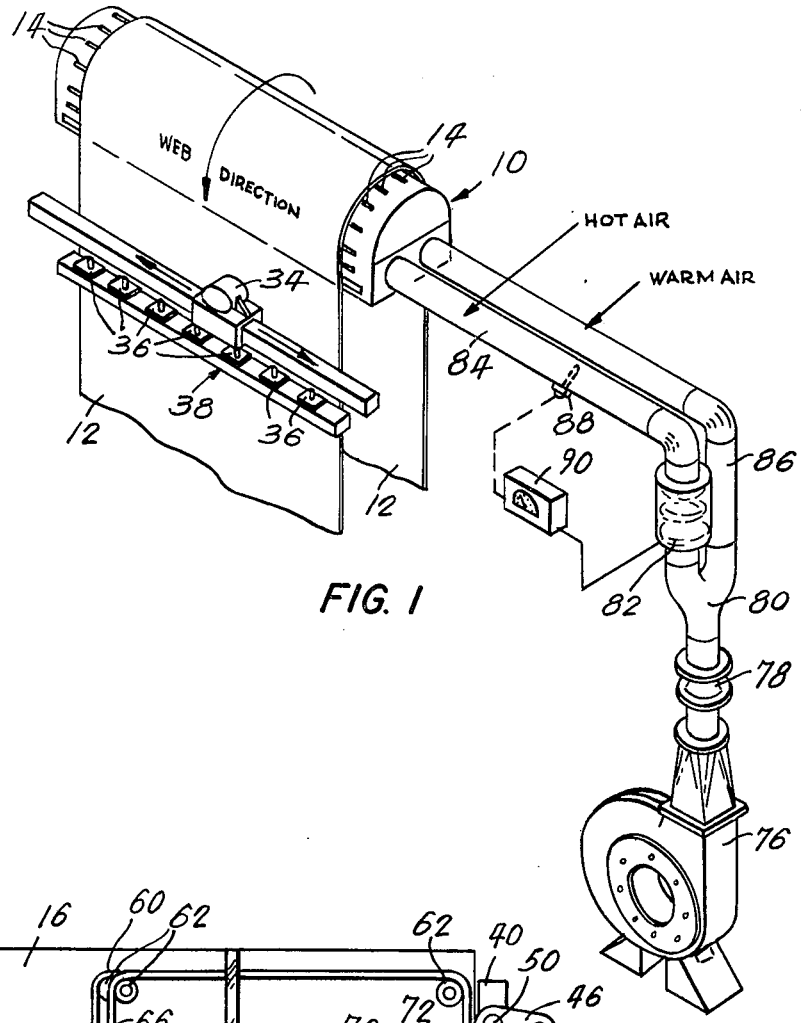
FIG. 1 is an isometric view with parts omitted illustrating a simplified form of the present invention.

In the simplified arrangement shown in FIG. 1, the bearing 10 has no return air passages so that all the air injected by the bearing 10 must escape from under the web 12 by flowing laterally from the edges of the web 12 or longitudinally of the web from the areas where the web approaches and leaves the drier 10. The incoming air is directed toward the web 12 by a plurality of inlet slots 14.

The drier 10 is divided into a plurality of sections 16 each of which directs air onto a narrow section of the web as the web travels over the drier 10. These sections or chambers 16 are immediately above axially extending inlet ducts 18 and 20 for hot and warm air, provided in the bottom of the drier 10 and separated by a central partition 22 (see FIGS. 2 and 3).

Each of the chambers 16 is provided with a pair of slide valves 24 and 26 which overly apertures 28 and 30 forming the inlets from the ducts 20 and 18 respectively. Adjusting the position of the slide valves 24 and 26 adjusts the ratio of hot to warm air in each one of the sections 16 so that the drying rate in that particular section may be controlled. In the illustrated arrangement, adjustment of the valves 24 and 26 is accomplished by means of a mechanism generally indicated at 32 with the operation of each of these mechanisms 32 being controlled by a travelling sensor 34 (see FIG. 1) which traverses the web 12 in increments, senses the amount of moisture in the web at each station and actuates in succession the microswitches 36 of the bank of microswitches 38 to control the valves 24 and 26 in each of the chambers or sections 16.

The valve adjusting mechanism 32 comprises for each section 16 a slidably mounted bar 40 having a pair of dogs or pawls 46 and 48 pivotably mounted thereon by pivot pins 50 and 52 and actuated from their normal retracted position to their operative position by solenoids 42 and 44. A pair of anchoring devices 54 (only one shown) are slidably mounted on each of the bars 40 and are adjustable axially of the bar by means of an adjustment mechanism generally indicated at 56. The adjustment mechanism 56 may be actuated through the rod 58. There are two anchoring devices 54 and thus two adjustment mechanisms 56 and control rods 58 for each bar 40.

A cable 60 is trained around suitable pulleys or the like 62 and has opposite ends connected to one of the pair of anchoring devices 54 on the bar 40 for that section 16 and is firmly clamped to the slide valve 24 by a clamping device 64. A similar cable 66 trains around similar pulleys 62, is connected at its opposite ends to the other anchoring device 54 and is clamped to the slide valve 26 by a clamping device 68.

It will be apparent that each section 16 is provided with a pair of slide valves 24 and 26 connected to a bar 40 through suitable means such as cable 60 and 62 so that movement of the bar 40 for that particular section 16 automatically adjusts the ratio of hot to warm air entering that chamber 16.

The mechanism 32 is actuated by a reciprocating plate 70 having saw teeth 72 on one face thereof, with saw teeth at one end of the plate 70 facing in one direction and those at the opposite end facing the opposite direction. This plate 70 is located relative to the dogs 46 and 48 so that the saw teeth at one end of the plate 70 cooperate with the dogs 46 while the saw teeth at the opposite end cooperate with the dogs 48 when the solenoids 42 or 44 are actuated. Any suitable means for reciprocating the plate 70 such as the crank mechanism generally indicated at 74 may be used.

Air is delivered to the two inlet ducts 18 and 20 by a fan or blower 76 connected through pressure regulator 78 to a Y 80 which directs part of the air through a heater 82 and then by pipe 84 into duct 18 and the remainder of the air through pipe 86 into duct 20. The temperature of the air in the pipe 84 may be sensed by sensor 88 which through controller 90 regulates the heat transferred in the heater 82.

Figure 2:
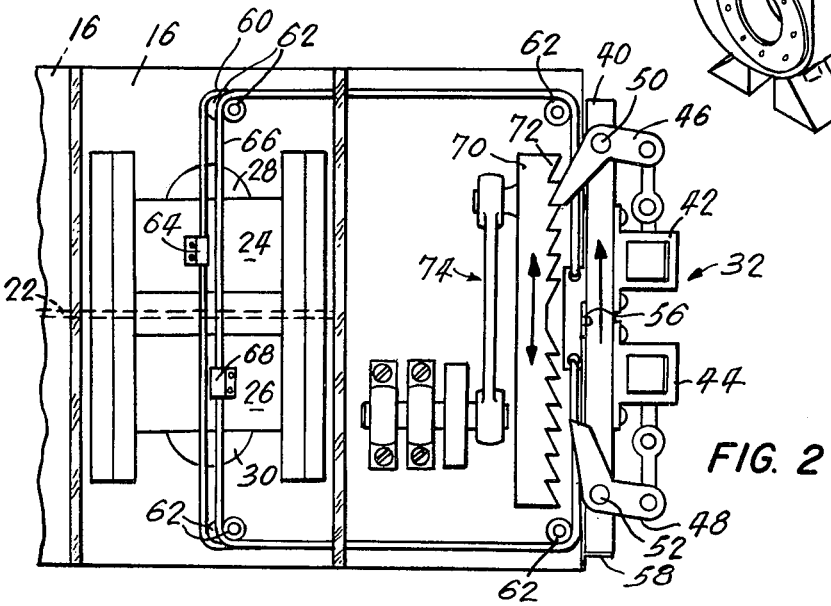
FIG. 2 is a plan view illustrating one form of valve and valve actuating mechanism.
Figure 3:
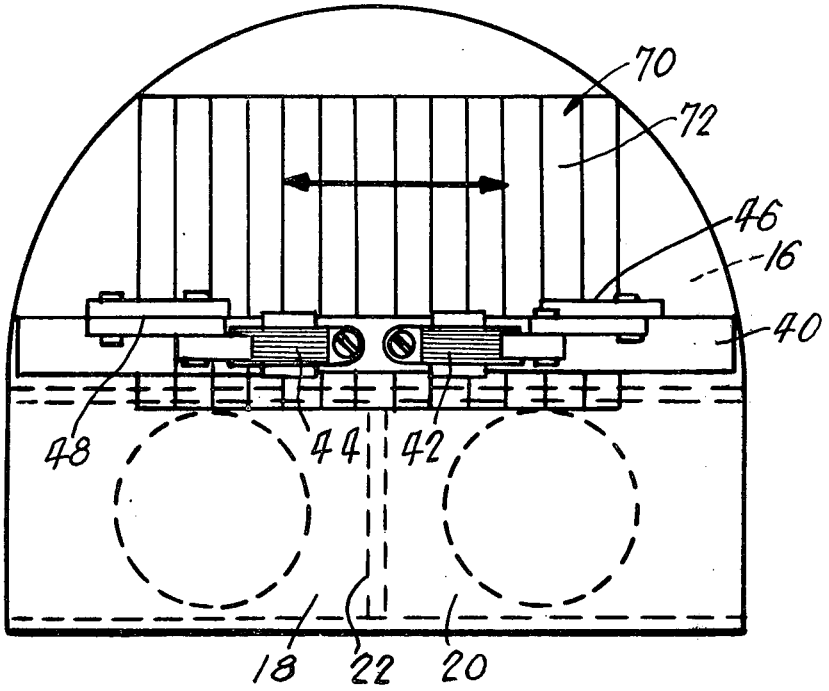
FIG. 3 is an end view of the air bearing of FIG. 1.

The operation of the FIGS. 1 to 3 embodiment will now be described. Air is delivered by the blower 76 to the pressure regulator 78 and one branch of the Y 80 through heater 82 and pipe 84 into the hot air duct 18 of the drier 10. As above indicated the temperature of this air may be controlled by a sensor 88 and controller 90 controlling the heat transfer in the heater 82. The remainder of the air from the blower 76 is directed by the other branch of the Y 80 through pipe 86 into the warm air duct 20. Air from the duct 18 issues through the apertures 30 in each of the sections 16 and mingles with the air issuing from the aperture 28 in communication with the duct 20 to provide an air mass of the desired temperature in each of the segments or chambers 16. The drying air moves substantially radially of the bearing through chambers 16 immediately under the web and is ejected through the slots 14 to impinge against the bottom side of the web 12 travelling thereover and dry the web 12. The temperature of the air in each of the chambers is adjusted in accordance with the moisture content of the section of the web that has just passed thereover. This control is obtained via sensor 34 which traverses the web 12 in increments and senses the moisture content of the web at each station. In each station the sensor 34 actuates a switch 36 in the bank of switches 38, there being one switch 36 for each section 16 and this actuates the solenoid 42 or 44 for the bar 40 for that section 16.

The sensor 34 may actuate the microswitch 36 in one direction or another or may simply not actuate the switch 36 all depending on the moisture content in the section of the web being sensed by the sensor 34. Assuming that the sensor 34 senses that the moisture content is too low for the particular section of the web being sensed then the solenoid 42 for the particular section 16 underlying that section of the web will be actuated to move the dog or pawl 46 to operative position illustrated in FIG. 2. The dog 46 in operative position engages one of the teeth 72 and as the plate 70 is moved in the upward direction in FIG. 2, the dog 46 moves with the plate 70 thereby moving the bar 40 and the cables 60 and 62 connected thereto to slide the two valves 24 and 26 downward thereby reducing the proportion of hot to warm air and reducing the drying capacity of that section of the drier. The dog moves with the plate 170 in one direction only and one step for each actuation of its solenoid 42 the dog automatically returning to inoperative position after each movement with the plate 170. Had the moisture content been too high the solenoid 44 would have been actuated to move the valves 24 and 26 in the opposite direction and increase the drying capacity of the section.

As the sensor traverses the web it will actuate the mechanism for stepping adjustment of the valves 24 and 26 for each of the sections 16 as required to attempt to even out the moisture profile of the dried web.

Fine adjustment by means of the adjustment mechanism 56 permits minor changes in the ratio of the hot to warm air issuing from the orifices 28 and 30 to compensate, if necessary, for the minor variations in pressure under the web in the various sections 16 due to the change in ratio of hot to warm air in these sections whereby the pressure under the web in all the sections is substantially the same to better ensure the web is uniformly supported across the full length of the drier 10. The latter adjustment could be made automatically by sensing the pressure in the chamber and maintaining it constant by a mechanism (not shown) adjusting the mechanism 56 (i.e., a sensor would be provided in each chamber).

The preferred embodiment of the present invention is illustrated in FIGS. 4 to 7 inclusive. This embodiment provides both means to inject and withdraw air from between the web being dried and the surface of the drier drum, and permits control of the drying capacity of each of the drier sections (equivalent to sections 16) that combine to dry the full width of the sheet.

The drier 100 is composed of a plurality of discrete segments or chambers 102, 104, 106 and 108. Only four have been shown in the illustrated arrangement but obviously more segments or chambers may be used depending on the width of the web to be dried and/or the desired width of each controlled segment. Suitable baffles or partitions 110, 112, 114, 116 and 118 separate and form the side walls of the various chambers 102, 104, 106 and 108 (see FIG. 5). Each pair of adjacent chambers function as the inlet and exhaust passages form one section of the drier equivalent to one of the sections 16 described hereinabove with respect to FIG. 1. Thus chambers 102 and 104 and the chambers 106 and 108 form two individually controllable drying sections.

Extending axially of the bearing beneath the floor 120 are ducts generally indicated at 122, 124, 126 and 128. The outside ducts 122 and 128 are return air ducts while the ducts 124 and 126 are air inlets. If desired, a single inlet duct may be used which may be provided by deleting the partition 130, however, it is preferred to provide two ducts as illustrated and to feed hot air through one of the ducts, say duct 124, and warm air through the other inlet 126 so that a temperature control can be obtained similar to the temperature control obtainable from the arrangement shown in FIG. 1.

Incoming air enters the chambers 102 or 106 through the apertures 132, 134 connecting the chambers 102 or 106 to the ducts 124, 126 respectively. Suitable control valves 136 and 138 are provided to control the flow through the apertures 132 and 134 respectively into the chambers. These slide valves 136, 138 may control the flow of hot and warm air in essentially the same manner as the valves 24 and 26 described hereinabove. This control will be applied through cables 140 and 142 respectively which are connected to a mechanism such as the mechanisms 32 shown in FIG. 1 in the same manner as the cables 60 and 66.

The exhaust passages or chambers 104 and 108 communicate with the exhaust ducts 122 and 128 through a pair of apertures 144 and 146 in each of the chambers 104 and 108. Control of the flows through these apertures 144 and 146 is obtained by the slide valve 148 which takes the form of a rectangular frame having transverse sections 150 and 152 interconnected by a pair of longitudinal sections 154 (only one shown) with the inner edge of the transverse section 152 spaced from the outer edge of the section 150 by a distance substantially equal to the spacing of the centres of the two apertures 144 and 146 so that movement of the valve 148 will tend to open or close the apertures 144 or 146 at substantially the same rate. In this manner, the flow in the ducts 122 and 128 may be balanced. The position of this valve 148 will normally be fixed for a given drying rate, however, the valve in each section may be adjusted slightly by means of cable 156 to tune the drier (i.e., to reduce flutter of the web). Such adjustments normally will only be necessary if the total volume of inlet air were increased or decreased for example by changing the spacing between slide valves 136 and 138 (i.e., by an adjustment mechanism equivalent to 56) to permit more or less air to pass through the orifices 132 and 134 or when the ratio of hot to warm air is adjusted to change the drying capacity of a particular section. Any suitable means for adjusting the position of the valve 148 may be used, for example it may be manually controlled, it may be controlled in accordance with the movement of the valves 136 and 138 or in accordance with the pressure within its respective chamber 104 and 108 or by a combination of such controls. A suitable pressure sensor (not shown) may be provided in each of the chambers 104 or 108 to sense the back pressure and means may be provided to adjust the valve 148 in its respective chamber to maintain a substantially uniform back pressure in chambers 104, 108 across the full width of the machine.

Figure 4:
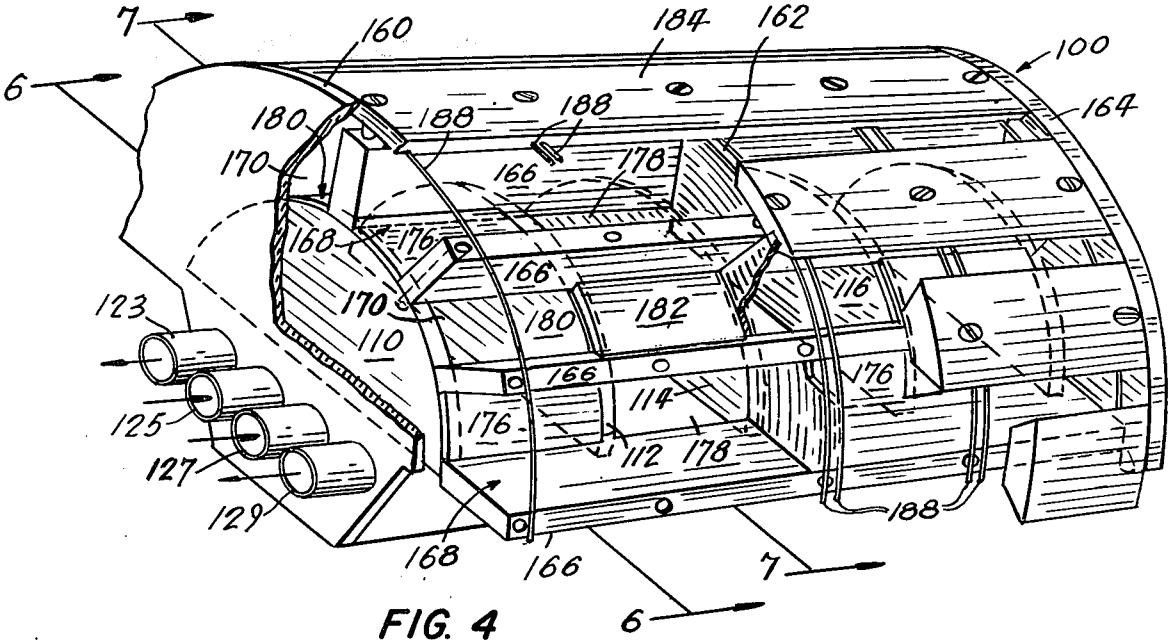
FIG. 4 is an isometric schematic view with parts broken away illustrating the preferred form of the present invention.
Figure 5:
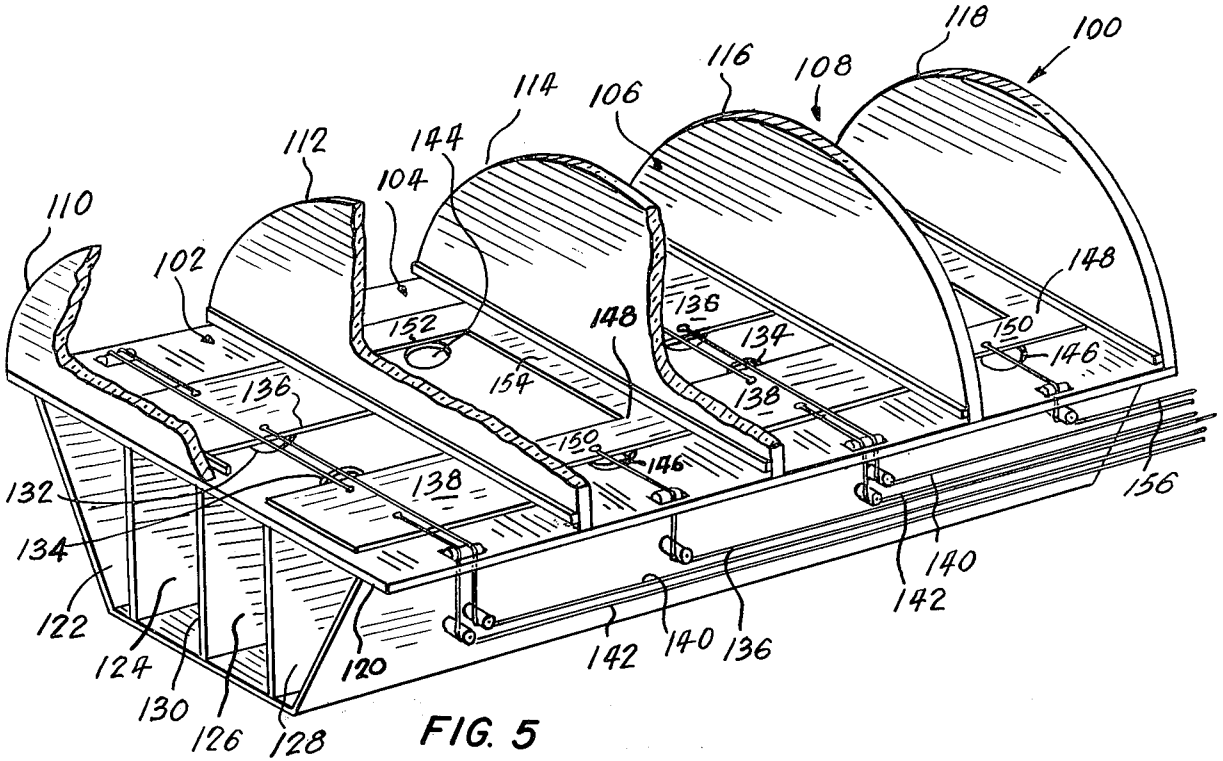
FIG. 5 is a view similar to FIG. 4 but with more parts broken away to more clearly illustrate the ducting and valving arrangements.

Referring to FIG. 4, it can be seen that the walls 110, 114 and 118 at opposite ends of each pair of adjacent chambers 102 and 104 or 106 and 108 forming a single drier section 16 are extended as indicated at 160, 162 and 164 respectively. Between the extensions 160 and 162 and between the extensions 162 and 164 are a plurality of axially extending radial partitions 166 which divide the periphery of the bearing into a plurality of radially spaced compartments designated as alternate compartments 168 and intermediate compartment 170 (see FIGS. 4, 6 and 7). Alternate compartment 168 is blocked off from the inlet chambers 102 and 106 by panels 176 but are in communication with the chambers 104 and 108 via openings 178 so that the alternate compartment 168 forms return passages communicating with the return ducts 122 and 128 through passages 104 and 108.

The intermediate compartments 170, each communicate with the chambers 102 or 106 through openings 180 and are blocked off from the chambers 104 and 108 by plate members 182. Thus air from the chambers 106 passes through the apertures 180 into the intermediate compartments 170.

The inlet orifices and outlet passages may be of any suitable form to accommodate the flows without undue flutter of the web. In the illustrated arrangement the inlet and outlet passages are defined by adjacent sides of a pair of adjacent orifices forming plates 184. These orifice forming plates 184 extend substantially the full axial length of the bearing and are secured to the upper surface of the axial partitions 66 by any suitable means. In the illustrated arrangement, screws are provided to cooperate with threaded openings in the partitions 66 and hold the plates 184 in position. The opposite ends of the plates 184 are tapered to provide a slot type orifice for directing incoming air against the undersurface of the web 12 at relatively high velocity.

Figure 6:
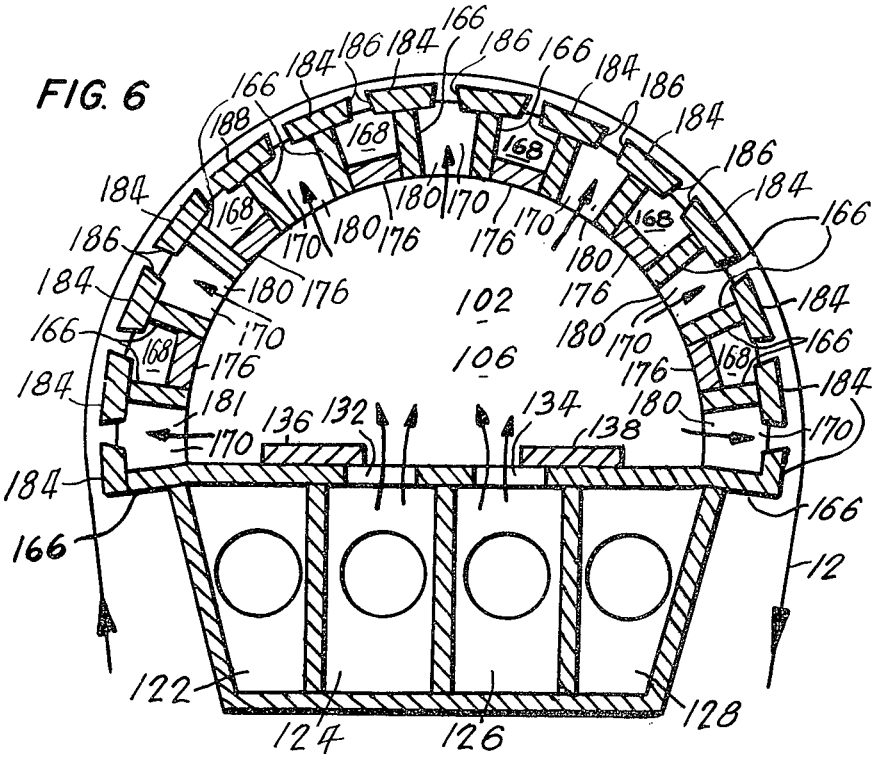
FIG. 6 is a section along the line 6—6 of FIG. 4.
Figure 7:
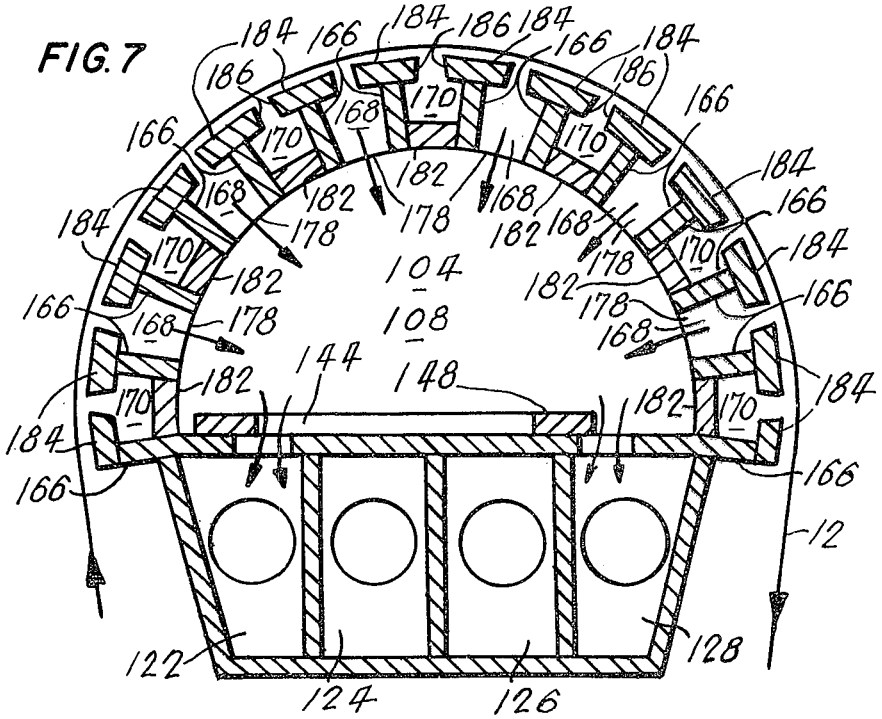
FIG. 7 is a section along the line 7—7 of FIG. 4.

To operate the preferred embodiment of the present invention, the ducts 122 and 128 are connected to the suction side of the fan by pipes 123 and 129 respectively while the ducts 124 and 126 are connected via the pipes 125 and 127 to sources of hot and warm air respectively under sufficient pressure to obtain the required velocity through the inlet orifices defined between adjacent plates 184 (see FIGS. 4, 6 or 7).

The hot and warm air in the ducts 124 and 126 pass through the orifices 132 and 134 into the chambers of passages 102 and 106 and from there through alternate compartments 170 (see FIGS. 4, 6 or 7) and is ejected at high velocity through the nozzles formed between pairs of adjacent plates 184 against the undersurface of the web 12. Each of the nozzles defined by the adjacent plates 184 extend the full length of the drier section defined by a pair of adjacent chambers or segments such as 102 and 104, and 106 and 108 (see FIGS. 4 and 6).

Air is withdrawn between the surface of the drier 100 and the web 12 through the alternate chambers 168 and passages 178 leading to chambers 104 or 108 and from there through orifices 144, 146 into the ducts 122 or 128 to be recirculated by the blower. Some of the exhaust air may be replaced with fresh air as required.

The control of the drying capacity for each of the sections (formed by a pair of compartments 102 and 104 or 106 and 108) is obtained by adjusting the position of the valves 136, 138 in the same manner as the valves 24 and 26 were adjusted in the FIG. 1 embodiment, i.e., a sensor 34 with microswitches 36 could be used to control the position of the valves 136 and 138 and thus vary the drying capacity in accordance with the moisture content of the web in each section after it has been dried, thereby to obtain a more uniform moisture profile.

As above indicated, the valves 148, the return passages 104 and 108 normally will require little adjustment but may be adjusted to maintain the back pressure substantially constant so that the web is uniformly supported all across the bearing. A pressure sensor in the chambers 104 and 108 may be used to automatically adjust the valves 148 to maintain the desired back pressure.

It will be noted that the ducts 122, 124, 126 and 128 are positioned below the main drier structure as were the ducts 18 and 20 in the earlier embodiment so that axial flow of air along the bearing is accommodated by ducts spaced from the drier surface. The incoming and exhaust air travels radially to and from the drier surface through the chambers 102, 106 and 104, 108 respectively so that there is little if any transverse flow of air in contact with the drier web. This is particularly important in the preferred embodiment, however, this mode of delivering air is also important in the simplified arrangement shown in FIG. 1 and is a feature of the invention that may be incorporated in bearings not equipped for profiling. In the latter type bearing the openings between the ducts and chambers may be a fixed size.

The control of drying air described hereinabove adjusts the ratio of hot to warm air. If desired, only one source of hot air (one hot air duct) may be provided and the quantity of such air delivered to each section be varied to vary the drying capacity of each section.

The disclosure has illustrated inlet and outlet slots together with one specific type of construction for forming these slots only. It will be apparent that the inlets and outlets may take other forms and need not be identical, for example, circular orifices or discrete slots or nozzles or any other suitable configuration may be used to form the inlets or outlets or both. For this reason, the term "nozzle means" used to describe the inlets in the claims is intended to include any suitable inlet for directing air at the required velocity against the sheet or web being dried. Also the structure of the bearing surface need not be as illustrated for example a skin or sheet material incorporating the required inlet and outlet openings may be substituted for the plate structure disclosed.

Also, in the disclosure no distributing baffles have been shown, however, such baffles may be provided where required, i.e., in the compartments, chambers or ducts depending on the relative sizes of the various openings and of the inlets and outlets and air velocity used, etc., to obtain the best distribution of air through the bearing.

Similarly the peripheral surface of the bearing in section has been shown as substantially circular but it will be apparent that the curvature need not be a circle but it should be convex to facilitate the application of tension to the web and thus increase the pressure that may be generated between the web and the bearing.

Modifications may be made without departing from the spirit of the invention as defined in the appended claims.

We claim:

1. An air bearing dryer for drying a travelling flexible web comprising means dividing said dryer into a plurality of side by side drying sections transverse to the direction of web travel whereby each section is adapted to dry a narrow width of web passing over said dryer, each of said sections comprising an inlet chamber and an exhaust chamber in side by side relationship transverse to the direction of web travel thereby providing alternative inlet and exhaust chambers transverse to the direction of travel of said web, each of said chambers having a floor; nozzle means communicating with said inlet chambers for directing air from said inlet chambers towards said web thereby to form an air bearing, outlet passages for directing air from between said web and said dryer into said exhaust chambers, inlet duct means and exhaust duct means on the side of said floor opposite said chambers, said inlet and exhaust duct means extending across said chambers, means connecting said inlet duct means with said inlet chambers and means connecting said exhaust duct means with said exhaust chambers without interconnecting said exhaust and inlet chambers.

2. An air bearing dryer as defined in claim 1 further comprising means to adjust flow from said inlet duct means to each of said inlet chambers and further means to adjust flow from each of said exhaust chambers to said exhaust duct means.

3. A drier as defined in claim 2 wherein said surface of said drier is arcuate in cross-section.

4. A dryer as defined in claim 3 wherein said inlet duct means comprises a pair of ducts, individual means connecting each of said pair of ducts with said inlet chamber of each of said sections and wherein said means to adjust adjusts flow from each of said inlet ducts into said inlet chamber in each said section.

5. A dryer as defined in claim 4 wherein said means to adjust comprises valves adapted to control the flow from each of said pair of inlet ducts into said inlet chamber of each of said sections simultaneously and independently of the flow to said inlet chambers the other of said sections.

6. A dryer as defined in claim 3 wherein each of said chambers is bounded by walls and wherein the walls between adjacent sections are of longer radius than the walls between said inlet and outlet chambers in one of said sections, axially extending partitions between said longer walls define a plurality of axially extending radially spaced compartments in each of said sections means connecting alternative of said compartments with said inlet chambers and means connecting intermediate of said compartments with said outlet chambers said nozzle means communicating with alternative of said compartments and said outlet passages communicating with said intermediate of said compartments.

7. A dryer as defined in claim 5 wherein each of said chambers is bounded by walls and wherein the walls between adjacent sections are of longer radius than the walls between said inlet and outlet chambers in one of said sections, axially extending the partitions between said longer walls define a plurality of axially extending radially spaced compartments in each of said sections means connecting alternative of said compartments with said inlet chambers and means connecting intermediate of said compartments with said outlet chambers said nozzle means communicating with alternative of said compartments and said outlet passages communicating with intermediate of said compartments.

8. A drier as defined in claim 7 wherein the said nozzles and said outlet passages are formed by the spacing between adjacent axially extending plates forming the surface of said drier.

9. An air bearing dryer as defined in claim 2 further comprising inlet and outlet compartment means, said inlet compartment means communicating said inlet chambers with said nozzle means and said outlet compartments communicating said outlet chambers with said outlet passages.

10. An air bearing dryer as defined in claim 4 further comprising means to feed hot air to one of said inlet ducts and means to feed air at a lower temperature to the other of said inlet ducts.

11. An air bearing dryer as defined in claim 5 further comprising means to feed hot air to one of said inlet ducts and means to feed air at a lower temperature to the other of said inlet ducts.

12. An air bearing dryer as defined in claim 6 further comprising means to feed hot air to one of said inlet ducts and means to feed air at a lower temperature to the other of said inlet ducts.

13. An air bearing dryer as defined in claim 7 further comprising means to feed hot air to one of said inlet ducts and means to feed air at a lower temperature to the other of said inlet ducts.

* * * * *